US005647221A

United States Patent [19]

Garris, Jr.

[11] Patent Number: 5,647,221

[45] Date of Patent: Jul. 15, 1997

[54] PRESSURE EXCHANGING EJECTOR AND REFRIGERATION APPARATUS AND METHOD

[75] Inventor: Charles A. Garris, Jr., Vienna, Va.

[73] Assignee: The George Washington University, Washington, D.C.

[21] Appl. No.: 541,653

[22] Filed: Oct. 10, 1995

[51] Int. Cl.[6] ..... F25B 1/00; F25D 17/00

[52] U.S. Cl. ..... 62/116; 62/500; 417/179

[58] Field of Search ..... 62/116, 500; 417/179, 417/180

[56] References Cited

U.S. PATENT DOCUMENTS

| | | | |
|---|---|---|---|
| 607,849 | 7/1898 | Hampson | 62/500 |
| 2,301,839 | 11/1942 | Work | 62/169 |
| 2,399,394 | 4/1946 | Seippel | 60/41 |
| 2,786,651 | 3/1957 | Mickle | 417/179 |
| 2,869,332 | 1/1959 | Keller | 62/238.4 |
| 3,046,732 | 7/1962 | Foa | 60/207 |
| 3,140,928 | 7/1964 | Spalding | 230/69 |
| 3,199,310 | 8/1965 | Schlichtig | 62/500 |
| 3,259,176 | 7/1966 | Rice | 62/238.4 |
| 3,277,660 | 10/1966 | Kemper | 62/116 |
| 3,367,563 | 2/1968 | Hertzberg | 230/69 |
| 3,680,327 | 8/1972 | Stein | 62/226 |
| 3,922,877 | 12/1975 | Ophir | 62/238 |
| 4,164,850 | 8/1979 | Lowi | 62/196 |
| 4,245,961 | 1/1981 | Bunting et al. | 417/171 |
| 4,301,662 | 11/1981 | Whitnah | 62/238.4 |
| 4,304,104 | 12/1981 | Grose | 62/324 |
| 4,342,200 | 8/1982 | Lowi | 62/191 |
| 4,378,681 | 4/1983 | Modisette | 62/500 |
| 4,487,553 | 12/1984 | Nagata | 417/179 |
| 4,523,437 | 6/1985 | Briley | 62/238 |
| 4,748,826 | 6/1988 | Laumen | 62/268 |
| 4,765,148 | 8/1988 | Ohashi | 62/116 |
| 4,905,481 | 3/1990 | Scaringe | 62/500 |
| 4,918,937 | 4/1990 | Fineblum | 62/175 |
| 5,117,648 | 6/1992 | Kowalski | 62/238 |
| 5,228,839 | 7/1993 | Peterson | 417/174 |
| 5,239,837 | 8/1993 | Kowalski | 62/238.6 |
| 5,309,736 | 5/1994 | Kowalski | 62/500 |

OTHER PUBLICATIONS

Huang, B. J., Jiang, C. B., Hu, F. L.: "Ejector Performance Characteristics and Design Analysis of Jet Refrigeration System", J.of Engineering for Gas Turbines and Power, ASME, v107, pp. 792–802, Jul. 1985.

Liepmann, H. W., Roshko, A.:"Elements of Gas Dynamics ", Section 5.4: Nozzle Flow, pp. 124–130, John Wiley, 1957.

*Primary Examiner*—William E. Wayne

[57] ABSTRACT

A novel ejector, an ejector-refrigeration system, and a method of refrigeration are disclosed. The system is particularly well suited for the utilization of energy sources such as waste heat from automobile engines and solar collectors. Further, the system is compatible with the use of environmentally benign refrigerant such as water. Unlike conventional ejectors, the novel ejector disclosed in the present invention is designed to utilize the principal of "pressure exchange" and is therefore capable of attaining substantially higher levels of performance than conventional ejectors whose operating mechanism is based on the principal of "turbulent mixing". The pressure exchanging ejector with a compressible working fluid utilizes the oblique compression and expansion waves occurring within jets emanating from the discharges of a plurality of supersonic nozzles so as to impart energy to a secondary gaseous fluid wherein the said waves are caused to move relative to the housing of said ejector by virtue of a motion inducing means applied to said nozzles, said nozzles being incorporated in a rotor. In the disclosed invention, the pressure exchanging ejector is utilized as an ejector-compressor with a vapor-compression refrigeration system whereby said working fluid constitutes the refrigerant.

21 Claims, 11 Drawing Sheets

PRESSURE EXCHANGING EJECTOR AND REFRIGERATION APPARATUS AND METHOD

FIELD OF INVENTION

The present invention relates ejector compressors and their application to space cooling systems for climate control or general thermal control purposes.

BACKGROUND OF INVENTION

Human productivity and quality of life has been substantially increased in recent years by the use of efficient climate control equipment for air conditioning and heating. The demands of food preservation and high technology instrumentation, equipment, and industrial processes have similarly required effective thermal control. Many of these needs have been effectively satisfied by the use of the reverse Rankine Cycle refrigeration system, the basic system of which consists of a refrigerant vapor compressor discharging into a condenser which liquefies the refrigerant while it rejects heat to the surroundings, followed by an expansion means which partially vaporizes the liquid refrigerant and lowering its temperature by virtue of absorbing its latent heat of vaporization. The refrigerant then passes to the evaporator which vaporizes the remaining liquid and absorbs heat from the cooling space, this vapor so produced is then returned to the compressor to repeat the cycle again.

As effective and commonly used as this system may be, it has three major drawbacks, all of which are associated with the use of the compressor:

The first is that the compressor is usually driven by high quality mechanical power provided by means such as an electric motor, mechanical power extraction from an engine, and the like. There are many applications where waste energy, either thermal or kinetic, is available and must be discarded and lost. One such example application is in automobile air conditioning where in the present state-of-the-art, a conventional reverse Rankine cycle refrigerator is used such that the compressor is powered directly through a belt drive by the engine, while large amounts of energy are lost through the engine exhaust and the cooling system. The energy extracted from the engine in this system to power the air conditioner clearly requires the expenditure of fuel with added cost and a resulting additional contribution to the pollution of the environment.

The second problem associated with current technology is that recent research has shown the chlorofluoromethanes (CFC's), the refrigerants of choice for the reverse Rankine cycle refrigeration system, have produced dire effects for the earth's ozone layer. Alternate refrigerants have been sought, particularly among the hydrochlorofluorocarbons (HCFC's), however, concerns have been raised about other environmental problems associated with these refrigerants. On the other hand, common water is an excellent refrigerant which has a high latent heat of vaporization, a high specific heat, good heat transfer characteristics, and is totally in harmony with the environment. However, for normal air conditioning applications, the specific volume of water vapor must be many times larger than that of a system using CFC's under comparable service requirements. Consequently, piston type compressors used with water vapor refrigeration systems require a much larger compressor displacement volume than those using CFC's as refrigerants. The need for a much larger compressor, and the associated increased cost, has rendered water to be less desirable as a refrigerant. However, this problem can be overcome by the use of an ejector which is capable of transporting large volumes of vapor within a relatively small space and at a low cost.

The third drawback of conventional reverse Rankine cycle refrigeration is the complexity of the compressor. This complexity increases the cost of the system, increases the maintenance required, and consumes excessive space or requires that the compressor be situated at inconvenient locations.

At the turn of the century when steam was more abundant than electricity, the patent literature reveals a plethora of inventions designed to produce refrigeration from thermal energy, thereby avoiding the aforementioned difficulties. These technologies were dominated by two classes of system: the ejector refrigeration system and the absorption cycle system.

In ejector refrigeration, a pump discharges condensate to a boiler/superheater which releases energetic primary vapor to the ejector. The ejector draws secondary vapor from the evaporator and discharges it to the condenser. The condensate from the condenser is divided between said pump inlet and the expansion means which supplies cool vapor/liquid to the evaporator. In accordance with the art of ejectors, the term "primary" is herein defined as the driving or energizing flow of the ejector. The term "secondary" is defined as the driven or energized flow. An early example of ejector refrigeration technology is disclosed in Hampson (U.S. Pat. No. 607,849) in 1898. Subsequent inventions disclosed strategies and methodologies for improving the performance of these systems by using various working fluids, multiple working fluids, and various heat sources (automotive waste heat, solar energy, geothermal power, combustion processes).

While absorption cycles received considerable attention, and still do, they have not competed well recently with conventional vapor-compression systems as a result of their higher weight, volume, and cost incurred by the need for the absorbent and the associated hardware for combining and separating absorbent and refrigerant. Although the system is capable of utilizing waste heat, the relatively low Coefficient of Performance (COP) of such systems has prevented adoption in many applications as well.

Ejector refrigeration has continued to draw considerable attention due is to its potential for low cost, its utilization of low-grade energy for refrigeration, simplicity, versatility in the type of refrigerant, and low maintenance due to the absence of moving parts. However, it has not, in fact, been widely adopted by because of the consequences of the low Coefficient of Performance that has hitherto been attainable. These consequences include higher energy consumption and the need for large and expensive condensers to handle the substantially higher thermal load.

It can be shown (e.g., Huang et al.,J. Engr. Gas Turb & Power,v107,1985) that the COP for a basic ejector refrigeration system operating at prescribed evaporator, condenser, and superheat conditions, is directly proportional to the ratio of the ejector secondary mass flow rate to the ejector primary mass flow rate. This ratio is commonly known to those skilled in the art of ejectors to be a fundamental figure of merit for the flow induction efficiency of an ejector. Hence, the higher the ratio of secondary to primary mass flow rates (mass flow ratio) the higher the COP. Thus, the performance of the ejector is a limiting factor in determining the performance of the refrigeration system. This has been recognized in the patent literature with many attempts at improving the ejector performance. This problem is discussed by Schlichtig (U.S. Pat. No. 3,199,310).

Work (U.S. Pat. No. 2,301,839), for example, taught that a conventional ejector can produce a higher mass flow ratio if the molecular weight of the primary is much larger than that of the secondary. This led to the concept of a two fluid ejector refrigeration system which required a separator and two fluid circuits to handle each of the working fluids. While the thermal performance of the system was demonstrably improved, the additional volume and complexity of the system was a major deterrent for its adoption. Various improvements on the conventional ejector were proposed so as to increase its efficiency. Examples are given in Schlichtig (U.S. Pat. No. 3,199,310) for a multi fluid ejector design, Kemper (U.S. Pat. No. 3,277,660) who discloses a "novel multi phase ejector", Stein (U.S. Pat. No. 3,680,327) who discloses a "compound ejector" for use in steam-jet refrigeration which introduces multiple primary jets through stationary nozzles in order to enhance mixing, Modisette (U.S. Pat. No. 4,378,681) teaches the introduction of swirl into the ejector in order is to facilitate entrainment of fluid by virtue of an increased residence time of the primary fluid inside the ejector, Lauman (U.S. Pat. No. 4,748,826) teaches the enhancement of ejector mass flow ratio by suction through porous ejector walls, Seatinge (U.S. Pat. No. 4,905,481) replaces the conventional ejector with a supersonic venturi and teaches the advantages of various working fluids; and Kowalski (U.S. Pat. Nos. 5,117,648, 5,309,736) who discloses ejector designs in conjunction with special working fluids requiring sonic flow at the entrance in order to enable the ejector to function efficiently with saturated vapor at the inlet.

All of the attempts at improving ejector performance have involved variations on the conventional design, known is to those skilled in the art of ejectors as the "steady-flow" ejector. The physical principal upon which this device functions is that of entrainment of a secondary flow by an energetic primary flow by virtue of the work of turbulent shear stresses. Thus, the relatively low energy secondary flow is "dragged" by the relatively high energy primary flow through tangential shear stresses acting at the interface between the two contacting streams. These turbulent stresses are a result of mixing that occurs between primary and secondary streams and the consequent exchange of momentum. While this mechanism is quite effective, and has been widely adopted in many applications, an inherent characteristic of mixing processes is to dissipate valuable mechanical energy. This results in a substantial entropy rise, which is intimately connected with ejector performance, and consequently refrigeration system performance. This effect may be clearly seen in the example calculations displayed by FIG. 8 showing a dramatic decline in COP with ejector entropy rise. While a designer might wish to compensate for this loss of performance by increasing the primary mass flow rate, another commonly known limitation on ejectors is that the mass flow which can be transported through an ejector is limited by the phenomenon of "choking" at the section of minimum area in the ejector. Thus, as discussed by Huang, further increases in primary flow beyond the choked limit do not further increase flow induction proportionately and the COP of the system drops precipitously.

The optimal performance for ejector refrigeration could theoretically be achieved if there were no energy dissipation. An idealization of this standard may be modeled by replacing the ejector by ideal turbomachinery. Such a system is shown in FIG. 6. In such a system the primary flow from the boiler imparts energy to a turbine which expands the vapor into a condenser. The turbine transfers its energy by direct mechanical coupling to a compressor which takes suction of secondary flow from the evaporator and also discharges to the condenser. In the ideal situation, both turbine and compressor discharge at the same entropy and pressure to the condenser. If all processes are isentropic, this system will attain the highest COP possible for a basic ejector-refrigeration cycle for a given working fluid, evaporator temperature, condenser temperature, boiler pressure and superheat temperature. Such an invention was disclosed by Rice (U.S. Pat. No. 3,259,176). Although the ideal performance of this system is a standard for which ejector refrigeration systems can be compared, in practice, it suffers from some deficiencies which have limited its adoption. The principal problem is the high cost of the required turbomachinery. Furthermore, while turbomachinery is capable of providing extremely high efficiencies with large scale machines, at the small scales required of many common refrigeration applications, one would not expect that the efficiencies would approach ideal, thus there would be expected a significant entropy rise. This was acknowledged in Rice (U.S. Pat. No. 3,259,176). Hence, in comparison with a very low cost ejector, the expense of high quality turbomachinery may not be justified for most applications. Furthermore, the additional weight of turbomachinery, in comparison with an ejector, may be a consideration in a particular design.

The energy equation governing the exchange of energy between a primary fluid and a secondary fluid may be written:

$$\frac{Dh^o}{Dt} = \frac{1}{\rho}\frac{\partial p}{\partial t} + T\frac{Ds}{Dt} + \frac{1}{\rho}\bar{u}\cdot\bar{f} \tag{1}$$

where:

h°=specific stagnation enthalpy t=time

ρ=density p=static pressure

T=static temperature s=specific entropy u=fluid velocity f=force per unit volume due to turbulent and viscous shear stresses If one considers a material element of fluid of infinitesimal volume and constant mass which enters the ejector through the secondary, the energy equation displays the physical mechanisms by which this secondary fluid element can acquire energy. Thus, the term on the left of Equation (1):

$$\frac{Dh^o}{Dt}$$

represents the acquisition of energy by the fluid element of unit mass as it moves through the ejector.

The first term on the right of Equation (1):

$$\frac{1}{\rho}\frac{\partial p}{\partial t}$$

represents the reversible work of pressure forces upon the fluid element. This term exists only if the flow is non-steady in the laboratory frame of reference and is a result of the fact that stationary pressure forces can do no work. When the work of the non-steady pressure field is utilized to affect energy transport from an energetic primary fluid to a less energetic secondary fluid which are brought into direct physical contact with each other, the process is termed "pressure-exchange". Hence, this term relates to the physical mechanism upon which the present invention relies.

The second term on the right of Equation (1):

$$T\frac{Ds}{Dt}$$

represents the energy received by the secondary as a result of heat transfer from the primary or from the environment and primarily contributes to the thermal energy level of the secondary rather than its mechanical energy.

The last term on the right of Equation (1):

$$\frac{1}{\rho}\bar{u}\cdot\bar{f}$$

represents the work of turbulent and viscous shear stresses and involves lateral mass and momentum transfer through irreversible transport processes. This is the process by which "steady-flow" ejectors rely. It is commonly known that this mechanism always results in a substantial entropy rise of the system.

The benefits of utilizing pressure exchange in a manner which employs compression and expansion waves are taught by Seippel (U.S. Pat. No. 2,399,394) who invented a class of pressure-exchanger often referred to as the "wave-rotor". This inventions comprise an assembly of cells rotating between fixed end walls having inlet and outlet openings for controlling the flow of the respective gas streams through the cells in succession. Advantage is taken of the compression and expansion waves which are set up in the succeeding cells by so locating the openings in the stationary end walls that each end of a cell is opened to an appropriate port substantially at the instant of the arrival at that cell end of a compression or an expansion wave. In these machines, one gas expands in such a manner as to compress another gas with which it is in direct contact. Means are provided for ducting to lead gas streams substantially steadily to and from the cells and means to effect rotation of the cells are provided.

The patent literature teaches several important properties of pressure exchanging devices. Seippel taught that if the flow passages were skewed in relation to the axis of rotation so as to affect an advantageous transfer of axial angular momentum, the rotors could be self-driven. Hertzberg (U.S. Pat. No. 3,367,563) taught that even with shock waves present, near isentropic energy transfer can be achieved. Hertzberg further taught that, contrary to the teaching of Work (U.S. Pat. No. 2,301,839), for a steady-flow ejector, the effectiveness of the pressure exchange process increases when the molecular weight of the driver gas is less than the driven gas as a result of the higher speed of sound in the lower molecular weight gas, enabling pressure waves to coalesce more effectively at the interface. The same effect occurs when the primary driver gas is of a higher static temperature than the driven secondary gas.

The benefits of pressure exchange and the deleterious effects of turbulent mixing on energy transfer are elucidated in Foa (U.S. Pat. No. 3,046,732). Foa also taught how pressure exchange could be effected in an ejector with interaction taking place externally to the rotor flow passages. This pressure exchange mechanism occurs as a result of the impact and deflection of the issuing jets of primary fluid from a plurality of nozzles, incorporated in a rotor, on the adjacent secondary fluid thereby creating a pressure field which rotates in accordance with the rotation of the rotor. Such a pressure field is non-steady in the laboratory frame of reference. It was further shown by Foa that if the orientations of the nozzles are skewed to the axis of rotation, the reaction of the issuing jet of primary fluid results in rotation of the rotor about its axis. Foa, however, contrary to the teachings of Seippel and Hertzberg, did not recommend the use of shock waves and expansion fans as a mechanism for creating the non-steady pressure field necessary for pressure exchange in flow induction devices.

The immense interest in pressure exchangers, wave rotors, and wave engines was largely concerned with propulsion applications and superchargers for internal combustion engines. Spalding (U.S. Pat. No. 3,140,928) taught that the "wave rotor" pressure exchanger concept could be used for "heat pump" applications whereby the pressure exchange process is utilized to produce "pressure equalization", the resulting equalized pressure being used for drying and distilling applications. No refrigeration function is disclosed. Other inventors have utilized the fact that when a gas expands isentropically, its temperature drops. By suitably arranging the ports of the wave rotor to collect expanded gas, cool gas can be extracted. However, nowhere in the prior art is it suggested to use pressure exchanging devices as part of a vapor-compression refrigeration system.

It is well known (e.g., Liepmann, H. W., Roshko, A.:"Elements of Gas Dynamics",pp124–130, John Wiley, 1957), that when a compressible fluid of given thermodynamic properties passes through a nozzle whose cross-sectional area initially decreases, then approaches a minimum area known as the "throat", and then increases to discharge the fluid at the nozzle exit, a pattern of compression and expansion waves may, or may not, appear at the nozzle exit depending on the ratio of the back pressure in the discharge region of the nozzle to the inlet stagnation pressure. If this pressure ratio is reduced below a certain level, a pattern of oblique shock waves and expansion waves appears at the exits of the nozzles. The various types of behavior, depending on pressure ratio, are indicated in FIG. 10.

There is an abundance of prior art on the utilization of engine waste heat for air conditioning purposes. Keller (U.S. Pat. No. 2,869,332) taught how steam generated by waste heat could be used to drive a turbine which would energize a conventional compressor in a vapor-compression refrigeration system. Ophir (U.S. Pat. No. 3,922,877) utilized waste heat of the engine of an automobile to power an ejector refrigeration system. Improvements on this theme were provided by Lowi (U.S. Pat. Nos. 4,164,850, 4,342,200) who discussed utilizing waste heat from the engine cooling jackets and from the engine exhaust. Presented in the preferred embodiments were two recuperators, viz., heat exchangers, to advantageously transfer heat from the warmer ejector vapor discharge to the cooler boiler/superheater feed condensate, thus reducing the amount of heat needed to be added in the boiler/superheater while reducing the amount of heat needed to be rejected in the condenser. The second recuperator disclosed is one which exchanges heat from the warmer liquid refrigerant before the expansion means and the cooler vapor discharging from the evaporator thus precooling the fluid to a temperature lower than that possible in the condenser. Huang also discussed the use of recuperators (using the altarnative terms "regenerator" and "precooler") and provided an analysis using experimental steady-flow ejector data showing how the COP of an ejector-refrigeration system is improved by the use of such recuperators. Ejector refrigeration improvements in automotive engines utilizing either cooling jacket waste heat or exhaust waste heat are disclosed in Briley (U.S. Pat. No. 4,523,437), Ohashi (U.S. Pat. No. 4,765,148), Fineblum U.S. Pat. No. (4,918,937), and Kowalski (U.S. Pat. Nos. 5,117,648, 5,239,837, 5,309,736).

It is well known that the ratio of the mass flow rate of secondary fluid to the mass flow rate of primary fluid diminishes as the quality of the primary vapor decreases because the ability of condensed droplets in a two-phase flow to entrain secondary vapor is minimal. For reasons previously explained, this has dire consequences for the COP of an ejector refrigeration system. Kowalski (U.S. Pat. No. 5,309,736) taught that condensation during the expansion of the primary vapor during mixing with the secondary in the ejector can be avoided by selecting a refrigerant having the property that its entropy when in a saturated vapor state decreases as pressure decreases. Although a variety of hydrocarbons were identified as meeting this requirement, many were toxic, flammable, or had otherwise undesirable characteristics as refrigerants.

An obvious method of avoiding condensation in the ejector is to employ a sufficiently superheated primary. This method was employed by Whitnah (U.S. Pat. No. 4,301, 662). While this method is effective, ff the ejector is not efficient for other reasons, much of this additional heat added in the superheater must be rejected later in the condenser. The additional thermal loading on the condenser would tend to increase its size and weight. Hence, the benefit to ejector performance of superheating the vapor is mitigated by the additional energy supply requirement and the added heat rejection requirement. This dichotomy can be resolved if the improvement in ejector performance so reduces primary mass flow rate that both the total amount energy supplied and the amount of heat to be rejected in the condenser are diminished. Unfortunately, this has not always been the case and this is a reason why superheaters have not been universally adopted in ejector refrigeration systems.

SUMMARY OF INVENTION

By means of the present invention, a refrigeration system possessing the previously discussed advantages of ejector refrigeration while overcoming many of its discussed disadvantages is disclosed. The innovation enabling this improvement is a novel ejector that utilizes an entirely different physical principal than that of the steady-flow ejectors heretofore employed in ejector refrigeration systems: pressure exchange. In the ejector herein disclosed, energetic vaporized refrigerant is conducted via the primary circuit of the ejector to the inlets of a plurality of supersonic nozzles which are incorporated into a rotor which preferably rotates at a peripheral speed within an order of magnitude of the exit speed of the primary fluid. The rotation of the rotor is preferably produced by skewing the nozzles with respect to the axis of rotation so as to make the rotors self-driving, however, the rotor may be externally driven. The vapor is accelerated to supersonic speeds while traversing the rotating nozzles, and at the nozzle discharge, characteristic patterns of compression and expansion waves are produced by designing the system so as to provide a nozzle exit back-pressure less than a critical value which is dependant on nozzle inlet stagnation pressure, the nozzle design, and the thermodynamic properties of the refrigerant. The secondary flow, drawn from the refrigeration system evaporator, generally at a lower temperature than the primary fluid, is brought into direct contact with the primary flow exiting from the nozzles by means of appropriate channels in the ejector housing and aerodynamic passages, and by virtue of the tangential motion of the pressure waves, transfers energy from the primary to the secondary flow through the mechanism of pressure exchange. Subsequent to the pressure exchange process, additional energy may be exchanged between primary and secondary fluids by virtue of mixing. Ducts are connected to the ejector housing to conduct the discharge flow to the refrigeration system, generally to the condenser.

In operation, a pump extracts condensed refrigerant from the condenser and feeds it into a boiler/superheater. The vapor therein produced is conducted to the primary of said pressure-exchange ejector. Said ejector draws its secondary fluid from the evaporator of the refrigeration system and discharges the combined flows to the condenser of the system. Part of the condensate is extracted from the condenser and is conducted to the expansion means which partially vaporizes the refrigerant fluid and lowers its temperature prior to entering the evaporator where heat is extracted from the cooling space and the refrigerant is completely vaporized. This vapor is then conducted to the ejector secondary, thereby closing the cycle. Recuperators, precoolers, and regenerators may easily be incorporated into the system. Similarly, the basic system could be easily adapted to a multi-fluid refrigeration system.

The advantage of the pressure exchange process is that, even accounting for shock losses, the entropy rise can be small. Post-pressure-exchange mixing will incur a much smaller entropy rise than would have occurred with primary-secondary mixing in a conventional ejector since the energy levels in the former are nearly equalized by pressure exchange. An objective of the present invention is to provide an ejector which is capable of exploiting this mechanism and thereby exhibits the minimum amount of entropy rise.

As a consequence of the minimal entropy rise in the ejector, the Coefficient of Performance of the ejector refrigeration system is greatly improved. It is an objective of the present invention to provide an ejector refrigeration system with a Coefficient of Performance considerably higher than that heretofore available and approaching that of the ideal turbomachinery standard.

In the preferred embodiment of the present invention, the primary fluid of the ejector is superheated to avoid condensation in the ejector. The degree of improvement of the Coefficient of Performance in comparison with using saturated vapor in the primary is sufficient to lower the total condenser heat rejection requirement by virtue of its reduced primary mass flow rate and thereby offset the additional energy which much be rejected by virtue of the energy added in superheating.

Further objectives of the present invention include:

Provision of a refrigeration system particularly well suited to the use of water or other environmentally benign refrigerants.

Provision of a refrigeration system particularly well suited to automobile climate control applications.

Provision of a refrigeration system well suited to various thermal energy sources such as solar energy and combustion processes.

Provision of a refrigeration system which is low in cost as a result of its simplicity.

Provision of a refrigeration system which is compact, light weight, and easily packaged within an environment of complex machinery.

For applications which require a very high degree of compression, it is advantageous to provide two or more ejectors in series. A further objective of the present invention is to provide an ejector which is amenable to ganging in series.

The above has been a brief description of some of the advantages of the invention when compared to some deficiencies in the prior art. Other advantages will be appreciated from the detailed description of the embodiments that follow.

DESCRIPTION OF THE PREFERRED EMBODIMENTS

Figure 1:
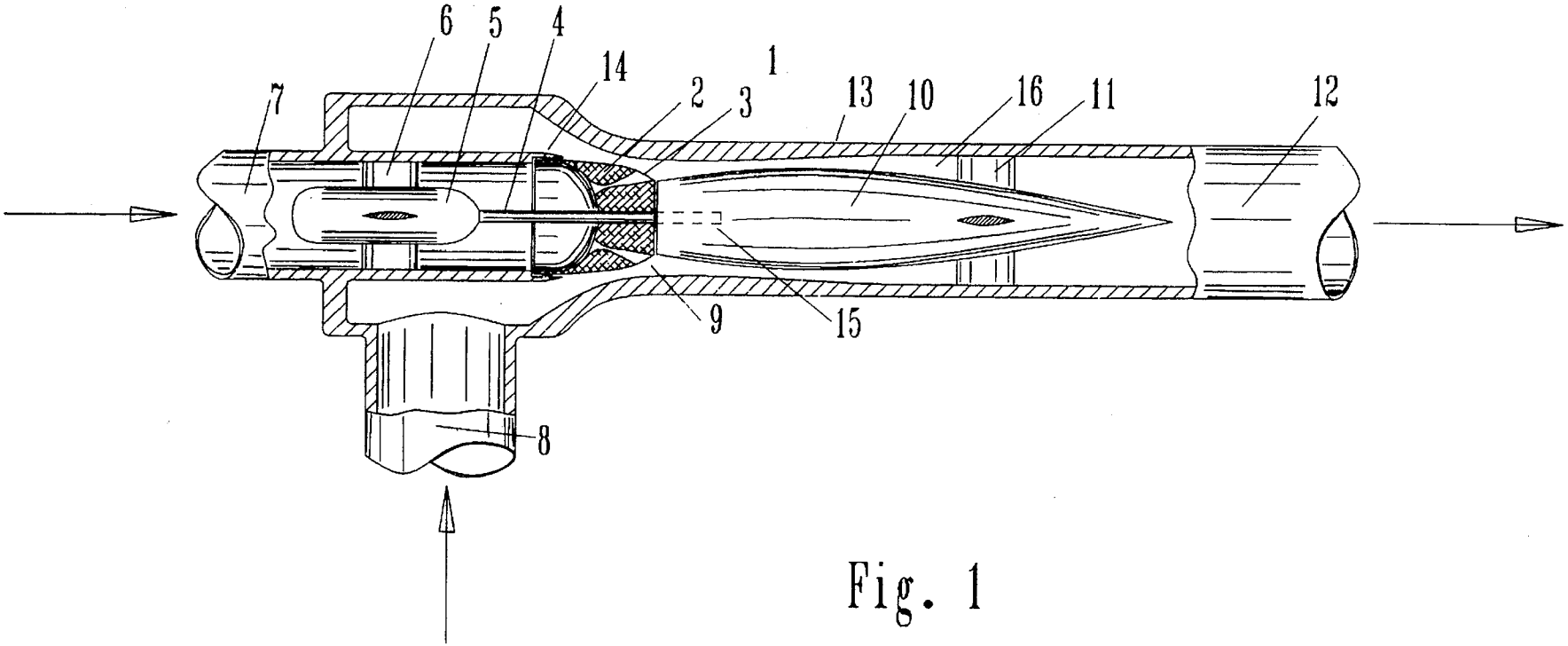
FIG. 1 is a sectional elevation of the preferred embodiment of the core-rotor pressure-exchange ejector including an axicentrically configured primary plenum and rotor with stationary afterbody.

An embodiment of the novel ejector disclosed in the present invention is shown in FIG. 1. Ejector 1 is enclosed by a housing 13 which permits the entry of energetic primary fluid through conduit 7, the entry of relatively low energy secondary fluid through conduit 8, and the discharge of the energetically intermediate combined flow through conduit 12. The primary fluid is directed to the entrance of a plurality of supersonic nozzles 3 which are incorporated in a rotor 2. The axes of discharge of the nozzles 3 are located at equal radial distances from the rotor's axis of rotation 4 and are distributed axi-symmetrically on the periphery of the rotor. The axis of discharge of a nozzle is herein defined as an imaginary line passing through the centroid of the transverse exit section of the nozzle and parallel to the fluid streamlines passing through said centroid. A supersonic nozzle generally has a converging section which gradually undergoes a transition to a diverging section. The section of minimum area is termed the "throat" and it is the location in the nozzle where the flow can become sonic. The downstream portion of the nozzle is generally considerably longer than the converging section because of the greater sensitivity to boundary layer separation in diverging channels. There are many configurations of supersonic nozzle 3 which a designer may select. Although nozzles of circular transverse cross-section are indicated in the drawings, rectangular, trapezoidal, elliptical, as well as asymmetric nozzles may be used. Furthermore, those skilled in the art might choose to have nozzle extensions protrude into the secondary fluid to further control the mutual deflection process. The rotor 2 is fixed to supporting shaft 4 along its axis of rotation. Shaft 4 is rotatably connected to spindle/motor 5 which is mounted into the ejector housing 13 through a multiplicity of radial struts 6. In the present invention, if the axes of nozzles 3 are skewed relative to the axis of rotation, the rotor may be self-driven and a motor drive function may be unnecessary. However, a designer may find advantage in incorporating a motor in 5 so as to independently control the rotor speed. In order to utilize the advantages of pressure exchange in the present invention, the nozzles must have a peripheral speed which is a substantial fraction of the jet speed downstream of the wave patterns. A substantial fraction is considered to be such that the ratio of nozzle peripheral speed to the primary fluid speed immediately after the compression waves is 0.10 or larger. Sealing means 14 is provided between the rotor 2 and the housing 13 so as to minimize the communication of primary and secondary fluids through flow paths other than the nozzles. The shape of the housing 13 and the shape of the rotor 2 are designed with aerodynamic surfaces to provide a converging channel which accelerates the secondary fluid prior to contact with the primary fluid. By reducing the difference in velocity between primary and secondary fluids, the dissipation caused by turbulent mixing can be reduced. A non-rotating afterbody 10 is provided to control the flow downstream of the nozzles 3. The afterbody 10 is supported by a multiplicity of radial strum 11 and by a rotatably connected bearing surface 15. An alternate arrangement rigidly fixes the afterbody to the rotor so that both rotate together. This configuration offers the advantage that struts 11 are eliminated, but may present difficulties in obtaining balanced and axicentric rotation. In operation, the primary flow exiting supersonically from the nozzles 3 form oblique shock waves and expansion fans which rotate with the rotor. The secondary flow is brought in subsonically from duct 8 and then accelerated to nearly sonic speeds in the converging annular channel shown prior to direct contact with said primary flow. Said primary issuing jets with their moving wave structure interact with the secondary flow in region 9 causing the induction of the secondary flow by means of pressure exchange. The deenergized primary and the energized secondary are then conducted past the afterbody 10 which is designed with aerodynamic surfaces so as to minimize the dissipation of stagnation pressure while diffusing the flows so as to maximize the recovery of static pressure at the discharge 12. Further mixing of the primary and secondary flows may occur in region 16. A shock may also appear in region 16 depending on the flow parameters.

Figure 2:
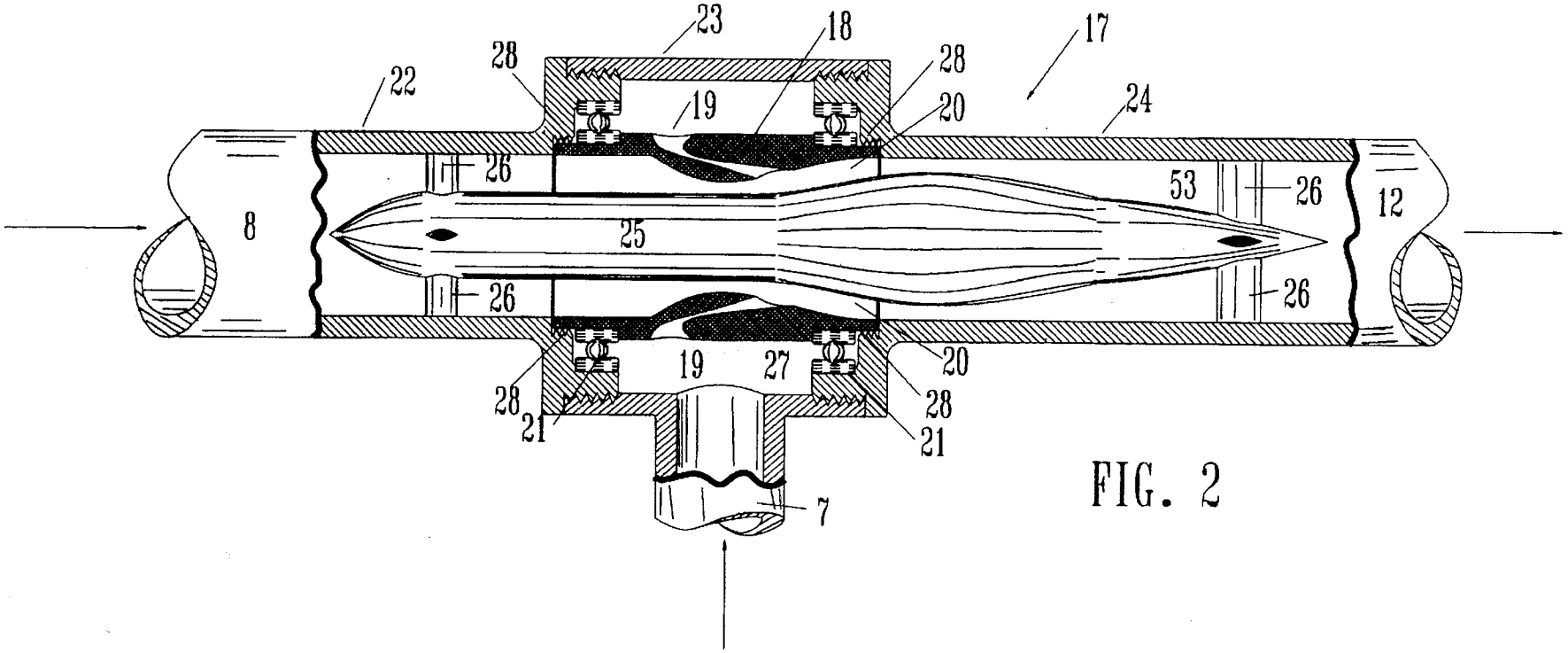
FIG. 2 is a sectional elevation view of a peripheral-rotor embodiment of the pressure-exchange ejector of the present invention. This embodiment has a peripheral primary plenum with axial secondary flow inlet and a stationary central body.

FIG. 2 shows a second embodiment of the present invention. Ejector 17 is enclosed by a multi-component housing 22, 23, 24 which permits the entry of energetic primary fluid through conduit 7, the entry of relatively low energy secondary fluid through conduit 8, and the discharge of the energetically intermediate combined flow through conduit 12. The energetic primary fluid is directed to the entrance of a plurality of supersonic nozzles 19, via a plenum 27, which are incorporated in a rotatably mounted rotor 18. The previous discussion for FIG. 1 relating to the design of supersonic nozzles applies to this and all embodiments of the invention. The nozzles 19 are generally skewed with respect to the axis of rotation so as to provide self-induced rotation. Otherwise, a motorized rotation means (not shown) must be provided. The rotor is rotatably mounted via bearings 21 in the multi-part housing 22, 23, and 24 and seals 28 are provided so that primary fluid does not directly communicate with the secondary fluid through paths other than the nozzles. The shape of the centerbody 25 and the shape of the rotor 18 are designed to provide aerodynamic surfaces such that a converging channel accelerates the secondary fluid prior to contact with the primary fluid. By reducing the difference in velocity between primary and secondary fluids, the dissipation caused by turbulent mixing can be reduced. A non-rotating centerbody 25 is provided to assure that fluid interactions occur with a minimal amount of energy dissipation. The centerbody 25 is mounted via forward and aft radial strum 26. The primary fluid emerges supersonically from the nozzles 19 exhibiting a pattern of compression waves and expansion fans (not shown) and engage the secondary flow in the interaction zone 20. The secondary flow is brought in subsonically from duct 8 and then accelerated to nearly sonic speeds in the converging annular channel shown prior to direct contact with said primary flow. By the mechanism of pressure exchange, the secondary flow is energized and the combined flow passes along the centerbody 25. Mixing between deenergized primary and energized secondary flows may occur and shock waves may occur along the centerbody in the diffusion zone 53. The centerbody is designed to provide maximal pressure recovery and minimal dissipation of stagnation pressure and to maximize the recovery of static pressure at the discharge 12.

Figure 3B:
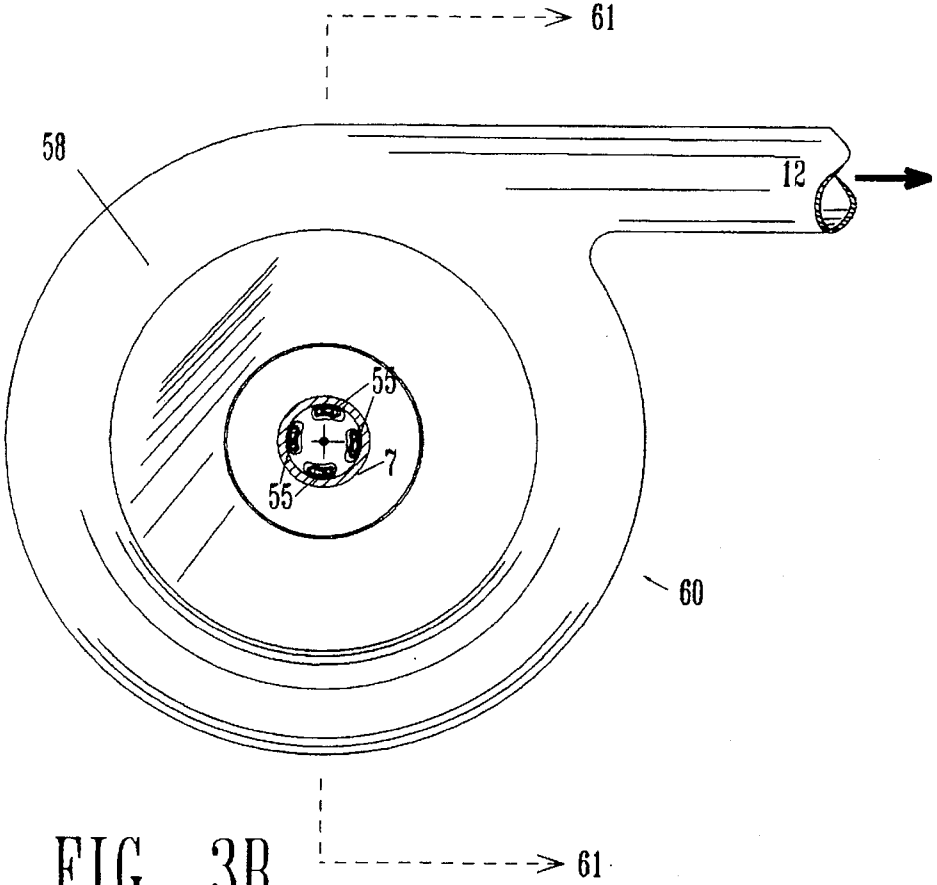
FIG. 3 consists of FIGS. 3A and 3B which are side and front elevational views, the former taken in section, of a radial flow embodiment of the pressure-exchange ejector of the present invention. This embodiment has both primary and secondary flows entering the ejector via ducts on axis but opposite sides. The combined flow leaves the ejector through a scroll on the periphery.
Figure 3A:
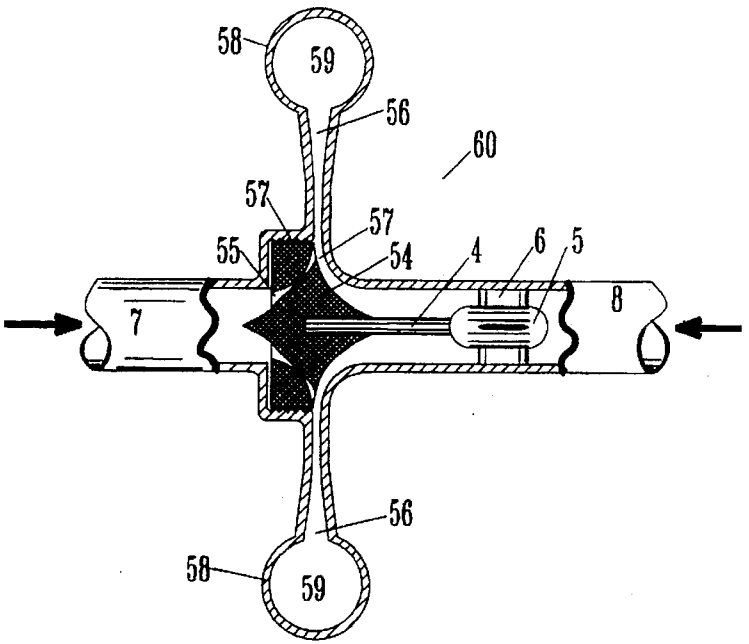

FIG. 3 shows a third embodiment of the pressure-exchange ejector of the present invention which utilizes a radial flow pressure exchange section. FIG. 3A is a sectional side-elevation view and FIG. 3B is an end elevation view showing the discharge scroll. Ejector 60 is enclosed by a housing 58 which permits the entry of energetic primary fluid through conduit 7, the entry of relatively low energy secondary fluid through conduit 8, and the discharge of the energetically intermediate combined flow through conduit 12. The primary fluid is directed to the entrance of a plurality of supersonic nozzles 55 which are incorporated in a rotor 54. Shaft 4 is rigidly fixed to the rotor 54 along its axis of rotation and is rotatably connected to spindle/motor 5 which is mounted into the ejector housing 58 through a multiplicity of radial struts 6. In the present invention, if the axes of nozzles 55 are skewed relative to the axis of rotation, the rotor may be self-driven and a motor drive function may be unnecessary. However, a designer may find advantage in incorporating a motor in 5 so as to independently control the rotor speed. Sealing means 57 is provided between the rotor 54 and the housing 58 so as to prevent direct contact between primary and secondary fluids through paths other than the nozzles. The shape of the housing 58 and the shape of the rotor 54 are designed with aerodynamic surfaces to provide a converging channel which accelerates the secondary fluid prior to contact with the primary fluid. By reducing the difference in velocity between primary and secondary fluids, the dissipation caused by turbulent mixing can be reduced. In operation, the primary flow exiting supersonically from the nozzles 55 form oblique shock waves and expansion fans which rotate with the rotor. The secondary flow is brought in subsonically from duct 8 and then accelerated to nearly sonic speeds in the converging annular channel shown prior to direct contact with said primary flow. Said primary issuing jets with their moving wave structure interact with the secondary flow in region 57 causing the induction of the secondary flow by means of pressure exchange. The deenergized primary and the energized secondary are then conducted through 56 which is a vaneless radial diffuser with aerodynamic surfaces so as to minimize the dissipation of stagnation pressure while diffusing the flows so as to maximize the recovery of static pressure and released into the scroll plenum which communicates with the discharge 12. Further mixing of the primary and secondary flows may occur in passages 56 and 59. An advantage of this type of ejector is that diffusion in passage 56 may be accomplishes with the absence of entropy-generating shock waves.

Figure 4C:
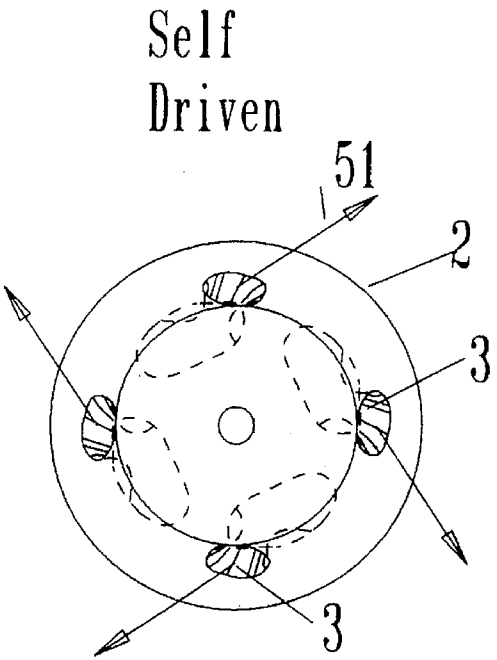
FIG. 4 consists of FIGS. 4A, 4B, 4C which is an axial elevation of the rotor of a core-nozzle pressure-exchange ejector and two transverse elevations, taken at the exit side of the rotor, one without nozzle skewing for externally driven rotors and the other showing nozzle skewing for self-driven rotors. Arrows indicating the direction of flow at exit are shown.
Figure 4B:
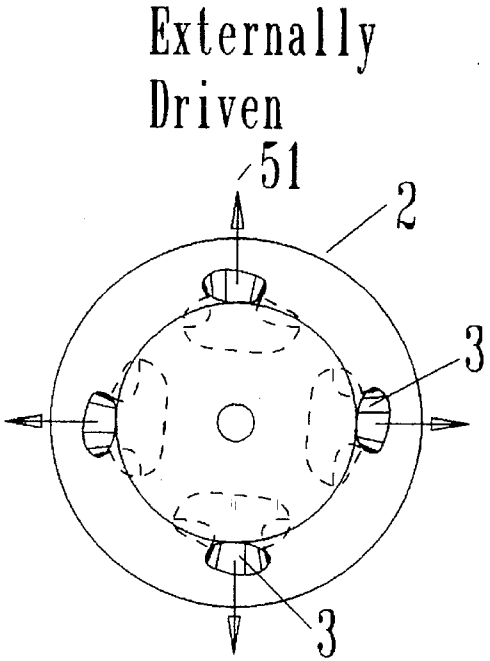
Figure 4A:
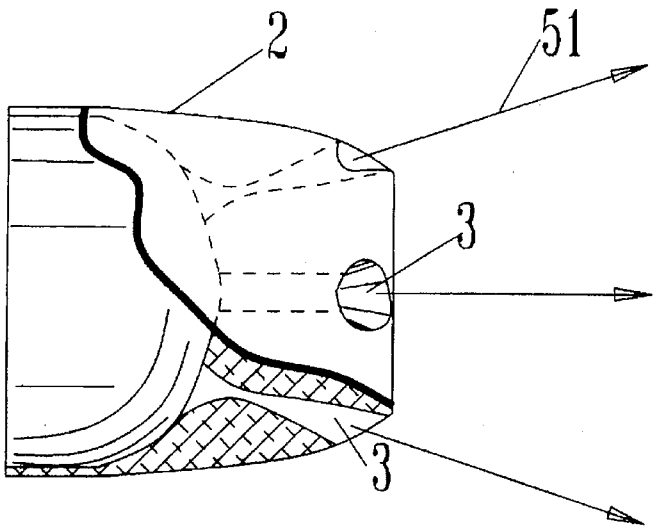

FIG. 4A shows the rotor 2 of FIG. 1 in side elevation sectional view with nozzles 3 indicated and arrows 51 showing the direction of flow. FIG. 4B is the same rotor shown with a rear elevation view with the discharge of nozzles 3 shown. Also indicated in dashed lines are the entrances to nozzles 3 which are located on the opposite upstream side of the rotor. The configuration of FIG. 4B shows how in the present invention, the rotor may be designed to provide a radial velocity component to the discharge flow from the nozzle 3 so as to promote better interaction between primary an secondary flows. Since there is no tangential component to the exit velocity and the nozzles are not skewed relative to the axis of rotation, such a rotor would not be self-driven and would require a motor means to provide rotation. The configuration of FIG. 4C also shows a rotor 2 corresponding to that shown in FIG. 1., however, the axes of the nozzles are shown skewed relative to the axis of rotation. A tangential velocity component relative to the rotor is thereby imparted to the fluid as indicated by the arrows 51. This configuration would be self-driven and a motor means external to the rotor would not be required. The arrows of FIG. 4C further show that the relative velocity exiting the nozzles 3 also has a radial component. While the example shown in FIG. 4 has four nozzles 3, the invention is applicable to any number of nozzles. The requirements of proper balance for high speed rotors generally require that the nozzles be spaced equiangularly and symmetrically with respect to the axis of rotation. The number of nozzles would depend on the design ratio of primary to secondary mass flow rates, the nozzle exit area, the flow geometry, and the primary and secondary fluid densities so that in the interaction space 9 of FIG. 1, there is adequate interaction space for the entwining primary and secondary flows.

Figure 5:
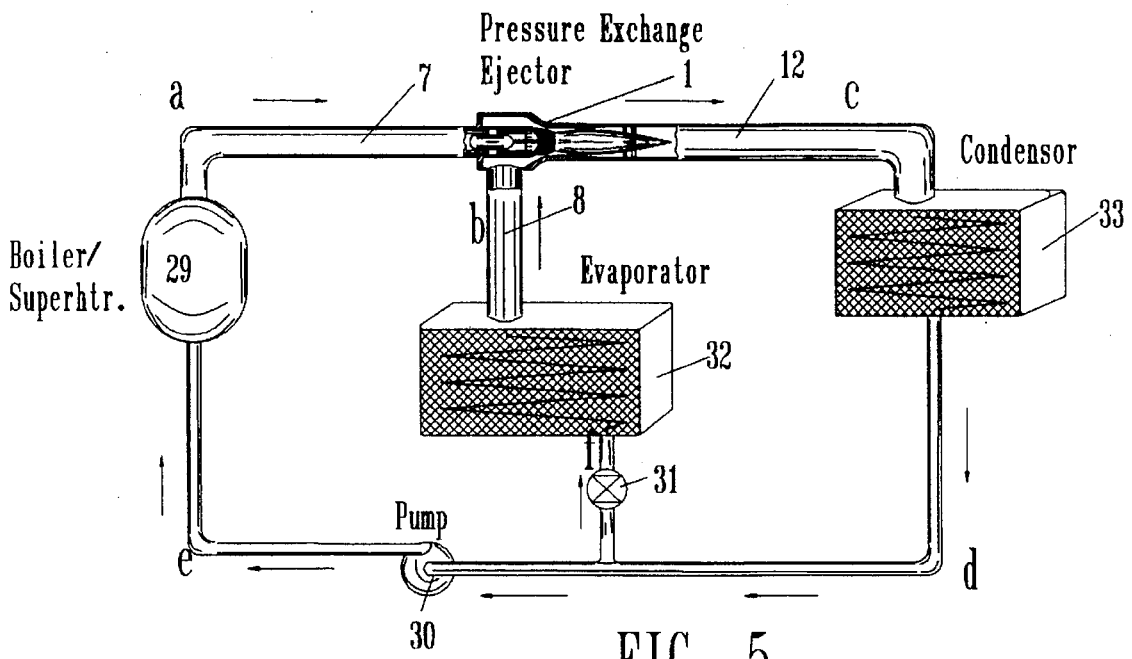
FIG. 5 shows the pressure-exchange ejector placed in a basic ejector-refrigeration system. Key components are labeled and arrows indicate the direction of flow. Letters refer to states to be shown later on the thermodynamic Moliere chart.

FIG. 5. shows the basic single-fluid ejector-refrigeration system into which the pressure-exchange ejector 1 is placed. The ejector embodiment of FIG. 1 is shown. The primary duct 7 of pressure-exchange ejector 1 is provided energetic vapor refrigerant by the boiler/superheater 29. The benefits of the present invention are still obtained when the vapor at the ejector primary inlet duct 7 is saturated, however, superheat is recommended to avoid condensation in the ejector and the consequent deterioration of performance. The boiler/superheater 29 is fed liquid refrigerant by a pump 30 which takes suction from the condenser 33. Also receiving liquid refrigerant from the condenser 33 is the expansion means 31 which partially vaporizes the liquid refrigerant and, by virtue of the absorption of the latent heat of vaporization, the temperature of the refrigerant is reduced substantially. The liquid/saturated-vapor mixture is then directed to the evaporator 32 where heat is absorbed from the environment to be cooled (not shown) and the remaining liquid refrigerant is fully vaporized to approximately saturated-vapor conditions. This vapor is drawn into the secondary of the ejector 1 through duct 8 and is therein compressed and discharged through duct 12 along with the primary fluid. The combined mixture of primary and secondary fluid vapors are conducted to the condenser 33 where heat is rejected to an appropriate thermal sink (not shown) and the vapor is condensed to approximately the saturated liquid state. The letters a, b, c', d, e, and f on the diagram label points in the thermodynamic cycle which will be referred to later. The benefits and advantages of the system shown are applicable to a wide range of refrigerants including water, ammonia, chlorofluorocarbons, hydrochlorofluorocarbons, hydrofluorocarbons, hydrocarbons, and others. Although only the basic ejector-refrigeration system is shown, the advantages of the present invention apply to more complex systems involving multiple fluids as well as the use of recuperators, precoolers, regenerators, and the like.

Figure 6:
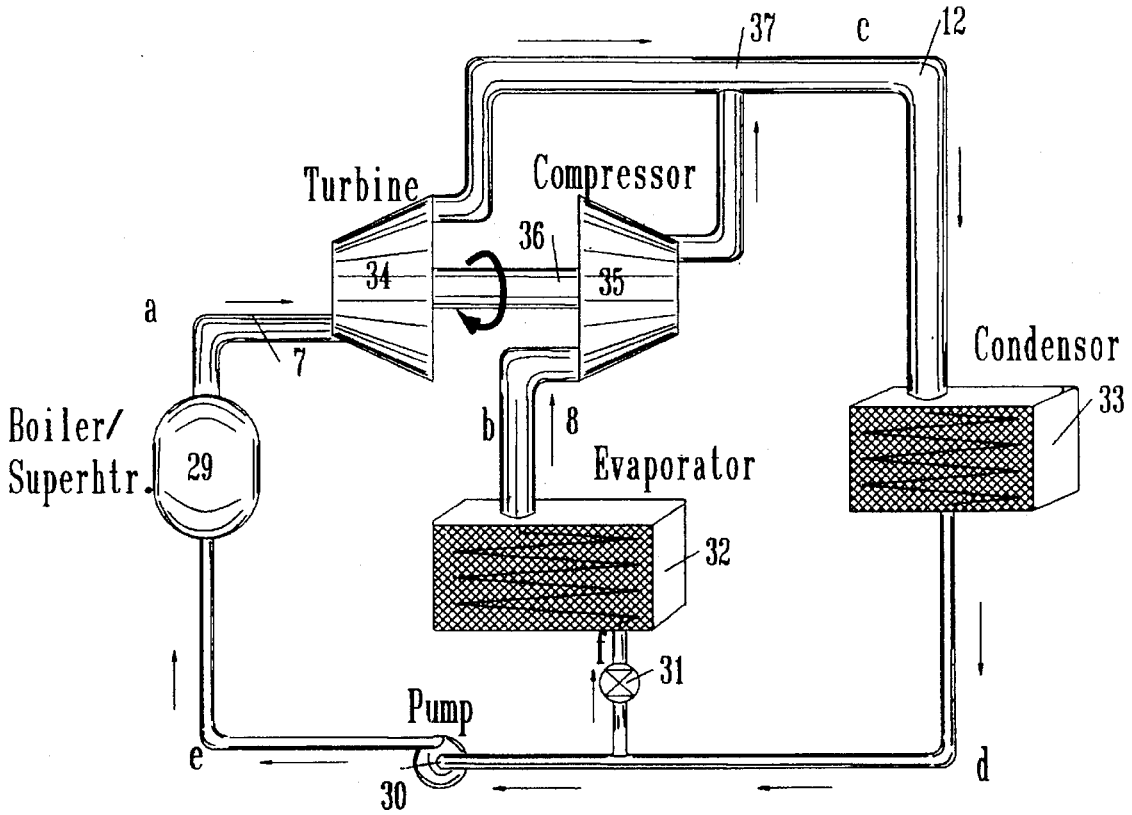
FIG. 6 shows the ideal turbomachinery analog of the ejector refrigeration system. With isentropic processes in the turbine and compressor and matched discharge conditions, it offers a standard of performance to which ejector refrigeration systems can be compared.

FIG. 6 shows a refrigeration system with the ejector replaced by a turbomachinery analogue. If the turbomachinery components are assumed to attain ideal efficiencies, this analogue offers a figure of merit to which ejector systems can only approach, but never reach due to their inherent irreversibilities. In this turbomachinery analogue, the primary vapor inlet 7, supplied from the boiler/superheater 29, is ducted to the inlet of a turbine 34 which drives the compressor 35 by means of rotating shaft 36. The compressor 35 takes suction from the evaporator 32 through secondary duct 8. The discharges from both turbine and compressor are joined at the junction 37 and the combined flow is brought through duct 12 to the condenser where heat is rejected to a thermal sink (not shown) and the fluid is condensed to approximately the saturated liquid state. As with the ejector refrigeration system of FIG. 5, the condensate is taken from the condenser and divided between the expansion means 31 and the pump 30. The liquid refrigerant going to the pump is discharged into the boiler/superheater 29 which provides energetic vapor to drive the turbine. The fraction of condensate ducted to the expansion means 31 is partially evaporated with the consequent reduction in temperature, and then brought to the evaporator 32 where the refrigerant absorbs heat from the cooling space and is vaporized. This vapor is then drawn into the inlet of the compressor 35 by duct 8. The letters a, b, c, d, e, and f on the diagram label points in the thermodynamic cycle which will be referred to later.

Figure 7:
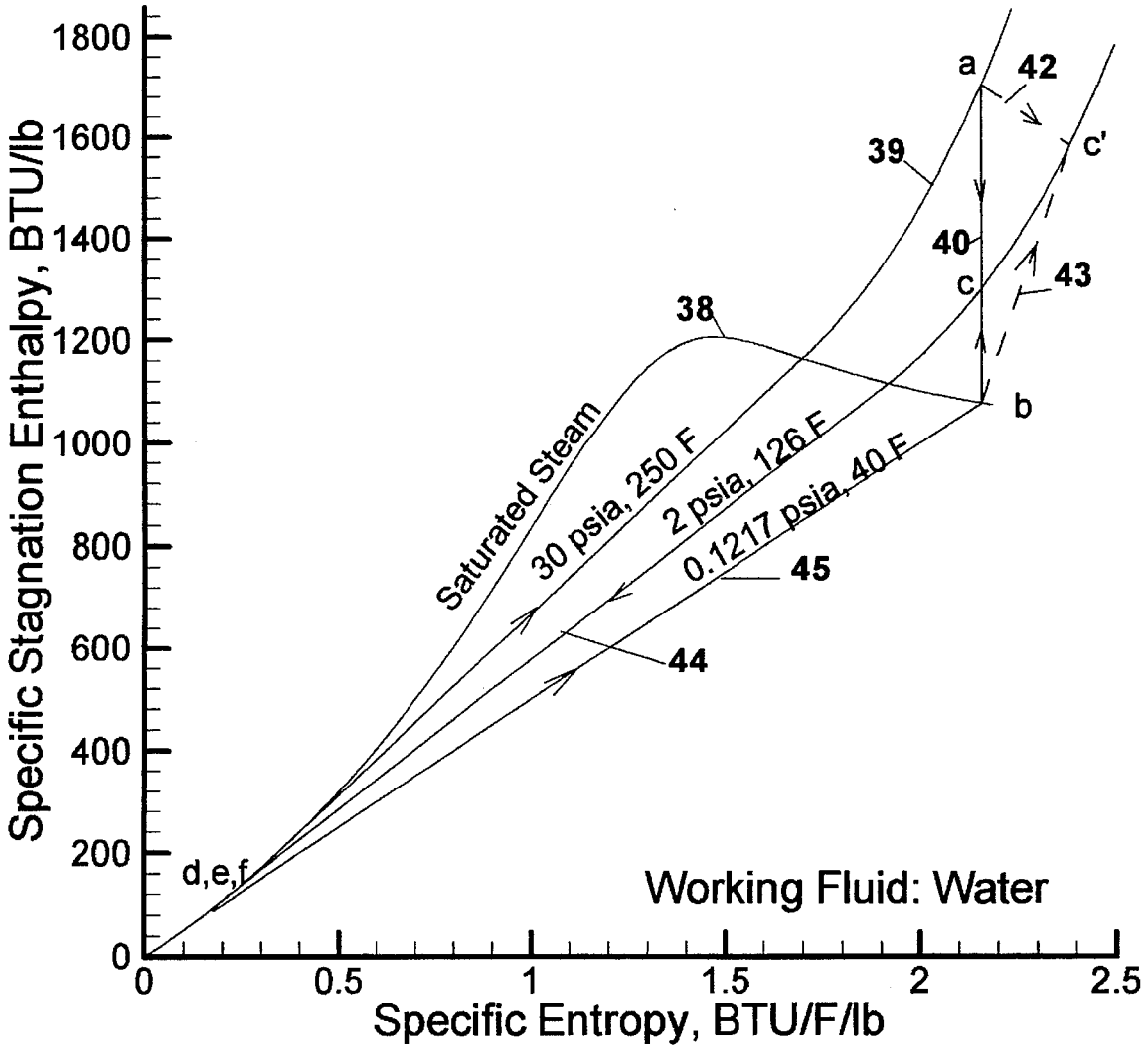
FIG. 7 shows an example Moliere Chart indicating an ejector refrigeration cycle under a set of design conditions with water as the working fluid. The saturation curve and the processes through the various components are indicated. The process a–c/b–c, shown with solid lines, corresponds to the ideal isentropic processes of the turbomachinery equivalent of the ejector. The process a–c'/b–c', indicated by dashed lines, corresponds to the irreversible processes occurring in a real ejector.

FIG. 7 is an example of a Moliere chart indicating the thermodynamic states corresponding to the ejector refrigeration system of FIG. 5 and the ideal turbomachinery analog of FIG. 6 for the exemplar case where the working fluid is water, boiler pressure is 30 psia, condenser pressure is 2 psia, and the evaporator temperature is 40° F., and where sufficient superheat is provided so that the entropy at the discharge of the boiler/superheater is equal to the entropy at the discharge of the evaporator. The letters a, b, c, c', d, e, and f on the diagram label points in the thermodynamic cycle which correspond to those same labels in FIGS. 4 and 5. Curve 38 corresponds to the saturation curve, curve 39 corresponds to the process in the boiler/superheater 29, curve 44 corresponds to the process in the condenser 33, curve 45 corresponds to the process in the evaporator. Curves 40 and 41 correspond to the ideal processes in the turbine 34 and the compressor 35 of FIG. 6, respectively. The dashed curves 42 and 43 correspond to exaggerated irreversible processes which occur in the primary and secondary flow paths, respectively, of the ejector system of FIG. 5. The dashed lines indicate that an irreversible process is occurring and that the path of the lines does not necessarily correspond to the actual processes. The ultimate effect of irreversibility can be noted by comparison of the points c' for the irreversible process and point c for the reversible process. One skilled in the art would readily note that for the irreversible processes, considerably more heat must be rejected in the condenser in process 44. Another consequence not apparent from the diagram is that for such irreversible processes 42 and 43, the mass flow rate of primary fluid must be much higher than that of the reversible processes 40 and 41 in order to produce the same amount of refrigeration in process 45. It is thus seen that the closer that the ejector processes approach those of the turbomachinery analog, the lower the heat rejection requirement in the condenser and the lower the mass flow rate in the primary circuit 39.

Figure 8:
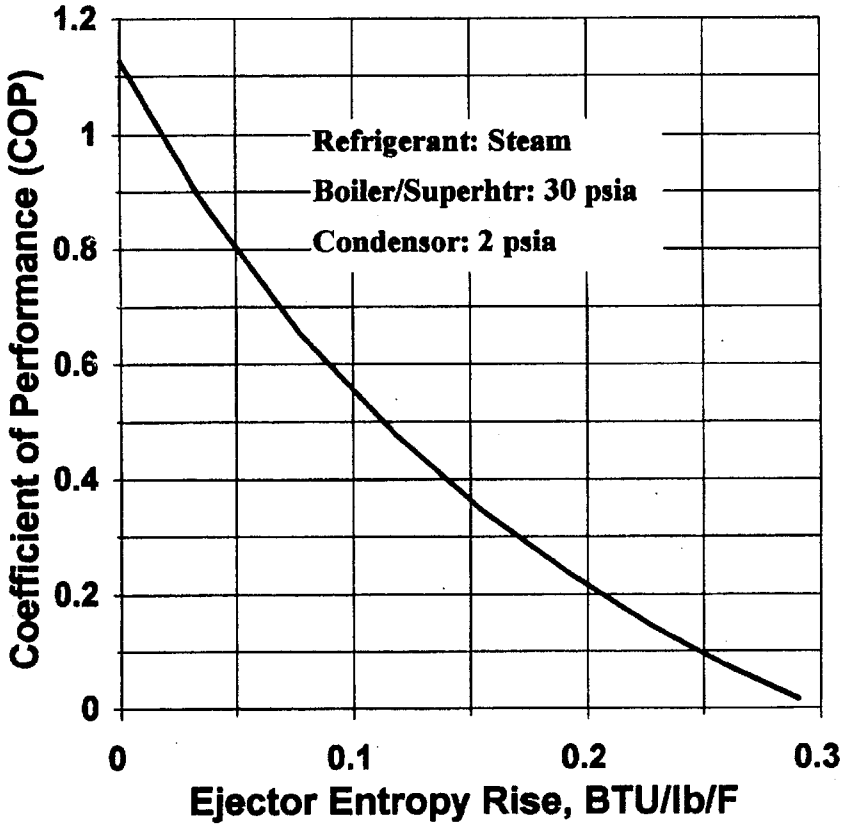
FIG. 8 is a chart showing for a stated set of design conditions, with water as the working fluid, how the ejector refrigeration system coefficient of performance is influenced by the entropy rise in the ejector.

FIG. 8 shows a plot of the Coefficient of Performance (COP) for the same system shown in FIG. 7 as a function of the entropy rise in the ejector. Zero entropy rise corresponds to the ideal turbomachinery analog. It is readily seen that as the entropy rise increases, the system COP decreases precipitously. Using Freon 113 under different conditions, Huang reports conventional ejector refrigerator COP's in the order of 0.2. FIG. 8 shows that the COP can be improved dramatically if the entropy rise can be controlled effectively. By means of the pressure exchange ejector which utilizes physical mechanisms which produce modest entropy rises, a substantial improvement over conventional technology is possible.

Figure 9:
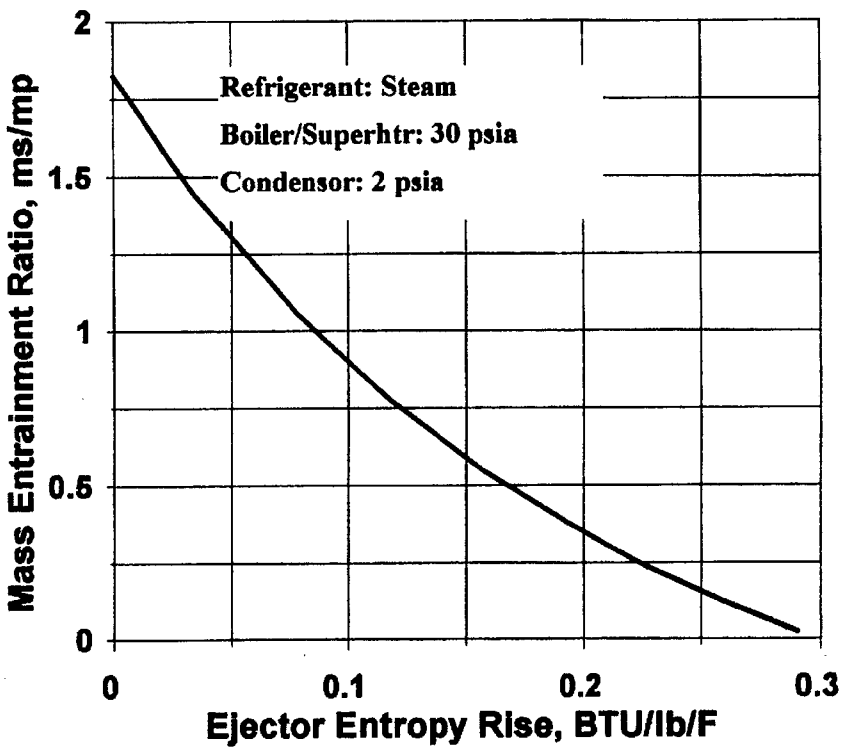
FIG. 9 is a chart showing for the same stated design conditions as indicated in FIG. 6 how the mass flow ratio drops with ejector entropy rise.

FIG. 9 shows a plot of the Mass Entrainment Ratio (ratio of secondary fluid mass flow rate to primary fluid mass flow rate) as a function of the entropy rise in the ejector for the same system as shown in FIG. 7. The ideal turbomachinery analog corresponds to zero entropy rise which also corresponds to the maximum value of the mass entrainment ratio. It can be seen that when the entropy rise is small, only a small amount of energetic superheated primary fluid is needed in order to drive the refrigeration system. However, when the entropy rise in the ejector increases, there is a rapid drop in the mass flow ratio indicating that much more fluid is needed in the primary circuit in order to drive the system. At a critical value of entropy rise, the mass entrainment ratio becomes zero, indicating the impossibility of driving the system under the given conditions with the ejector. When the entrainment ratio is small but positive, copious quantities of superheated vapor are necessary to drive the system which requires the expenditure of large amounts of energy to be provided in the boiler/superheater, and large amounts of heat to be rejected in the condenser. Both of these consequences of entropy rise require larger more costly components. By reducing the entropy rise in the ejector, the pressure-exchange ejector minimizes the energy requirement in the boiler/superheater while minimizing the amount of heat to be rejected in the condenser leading to a more cost-effective and space conserving system.

Figure 10A:
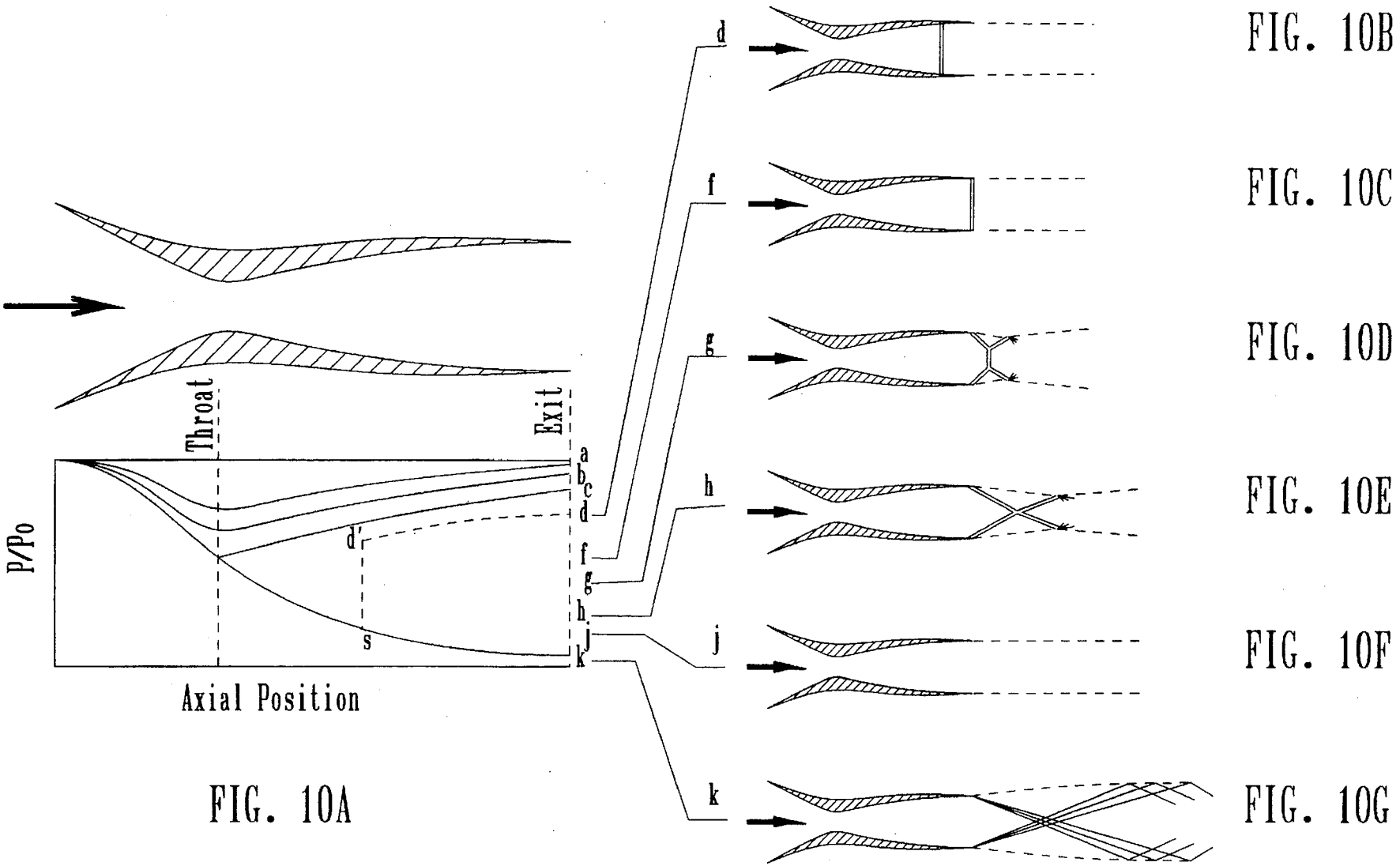
FIG. 10 which consists of FIGS. 10A–10G shows the wave structure exhibited at the exit of a supersonic converging-diverging nozzle and pressure. Pressure profiles along the length of the nozzle are also indicated.

FIG. 10 shows the well known behavior of a compressible gas passing through a supersonic nozzle of the type utilized in this invention. FIG. 10A shows the ratio of local static pressure to inlet stagnation pressure as a function of axial position in the nozzle. For the curves labeled a and b, the flow is subsonic throughout the nozzle. For curve c, the flow is subsonic everywhere except at the throat of the nozzle where it is sonic. If the pressure at the exit of the nozzle is reduced below its exit value on curve c, a normal shock wave is observed inside the nozzle as indicated in FIG. 10B which corresponds to curve d'-d in FIG. 10A. If the exit pressure is further reduced to a value corresponding to that indicated by f, the normal shock wave appears at the exit plane of the nozzle as indicated in FIG. 10C. If the back pressure is further reduced to values such as g, h, and k, for example, the shock emerges from the exit of the nozzle and a pattern of shock waves and expansion fans appear outside of the nozzle, the pattern depending on the back pressure. The resulting patterns are shown in FIGS. 10D,10E, and 10G. The configurations shown in FIGS. 10D and 10E are termed as "overexpanded", while the configuration of FIG. 10G is termed "underexpanded." When the back pressure exactly corresponds to j, the nozzle discharge is supersonic and shock free as shown in FIG. 10F. This configuration is termed "isentropically expanded" since there are no entropy increments associated with shock waves. The present invention utilizes the wave structure as indicated in FIGS. 10D, 10E, and 10G in order to exploit the beneficial effect in promoting pressure exchange to reduce the overall entropy rise of the ejector.

Figure 11:
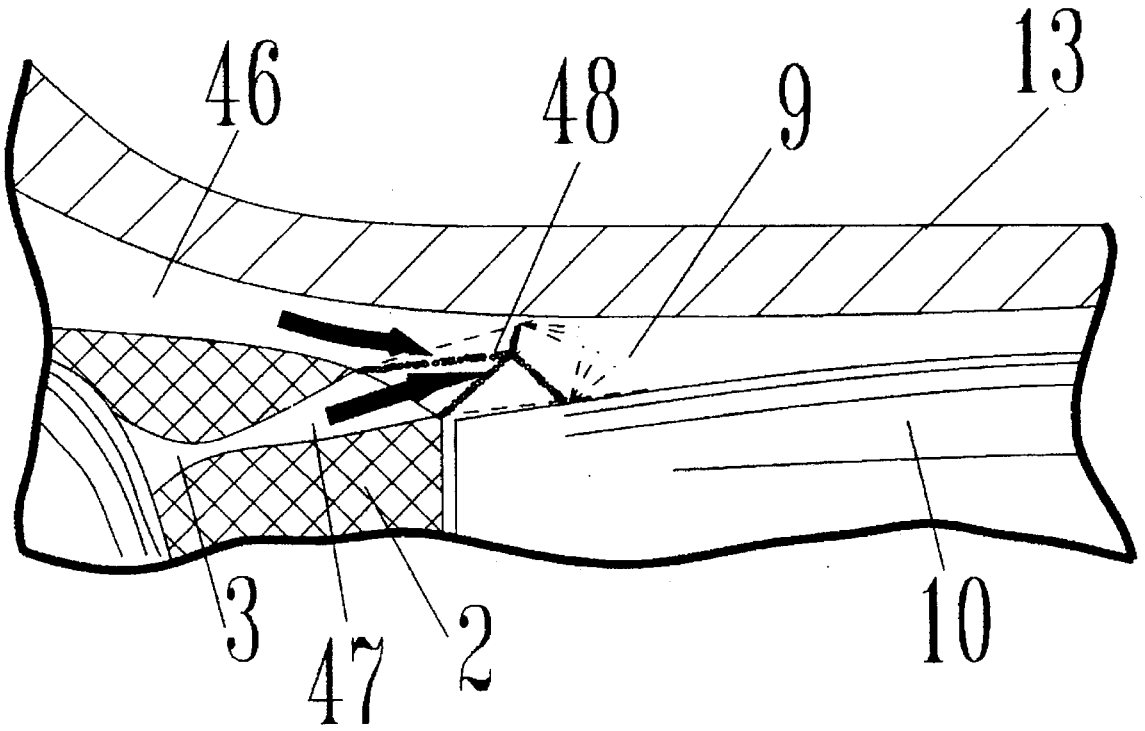
FIG. 11 is an enlargement of the rotor and nozzle exit of FIG. 1 indicating an example of the wave structure in the interaction space in accordance with the present invention. Arrows also indicate primary and secondary flows as they approach one-another.

FIG. 11 is an amplification of the primary-secondary flow interaction zone 9 of FIG. 1 where the wave structure 48 within a jet emanating from a nozzle 3 is shown. Arrows 46 and 47 indicate the flow of secondary and primary fluids, respectively, and how they interact in the annular zone 9 between the ejector housing 13 and the afterbody 10. In accordance with the present invention, as the rotor turns at high rotational speeds, the secondary flow 46 is trapped between the primary flows 47 and both undergo a mutual pressure exchange process which drives the secondary flow through the ejector.

Figure 12:
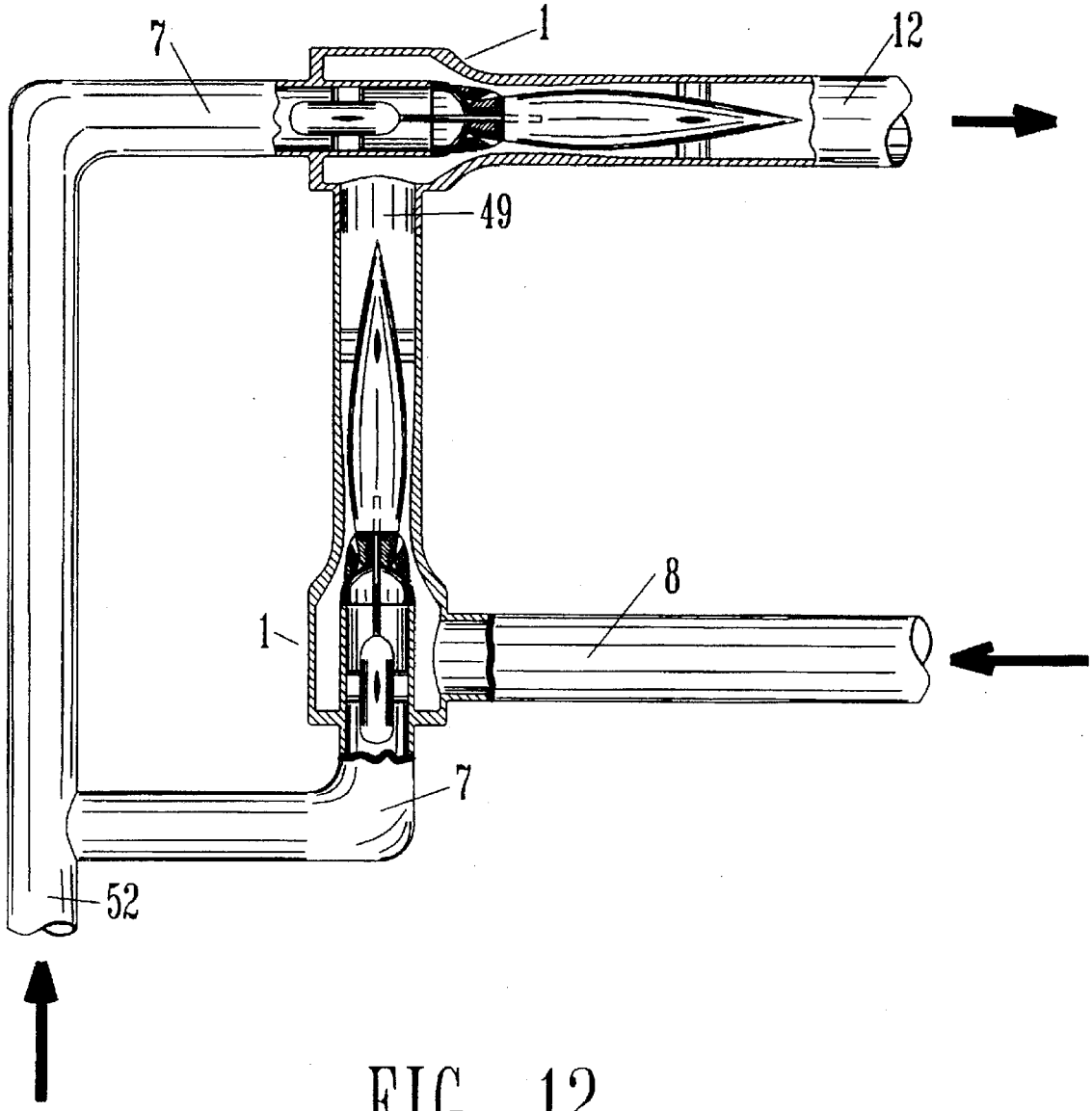
FIG. 12 shows a sectional elevation of two core-nozzle pressure-exchange ejectors placed in series such that the discharge from the first ejector constitutes the secondary flow of the second ejector. Both ejectors have a common primary flow supply. Arrows indicate flow directions.

FIG. 12 shows an embodiment where two ejectors 1 of the type shown in FIG. 1 are placed in series. The primaries of both ejectors 1 are fed through the same source 52 through primary inlet ducts 7. The secondary of the first ejector takes suction through duct 8 and the discharge of the first ejector 49 is fed into the secondary of the second ejector. The discharge 12 of the second ejector is therefore at a higher pressure than might have been possible with a single ejector for a given total entropy rise. A similar scheme could be applied to place a plurality of ejectors in series. Due to the increasing mass of fluid and the increasing pressure of each succeeding ejector, a designer might wish to size the ejectors optimally.

Figure 13:
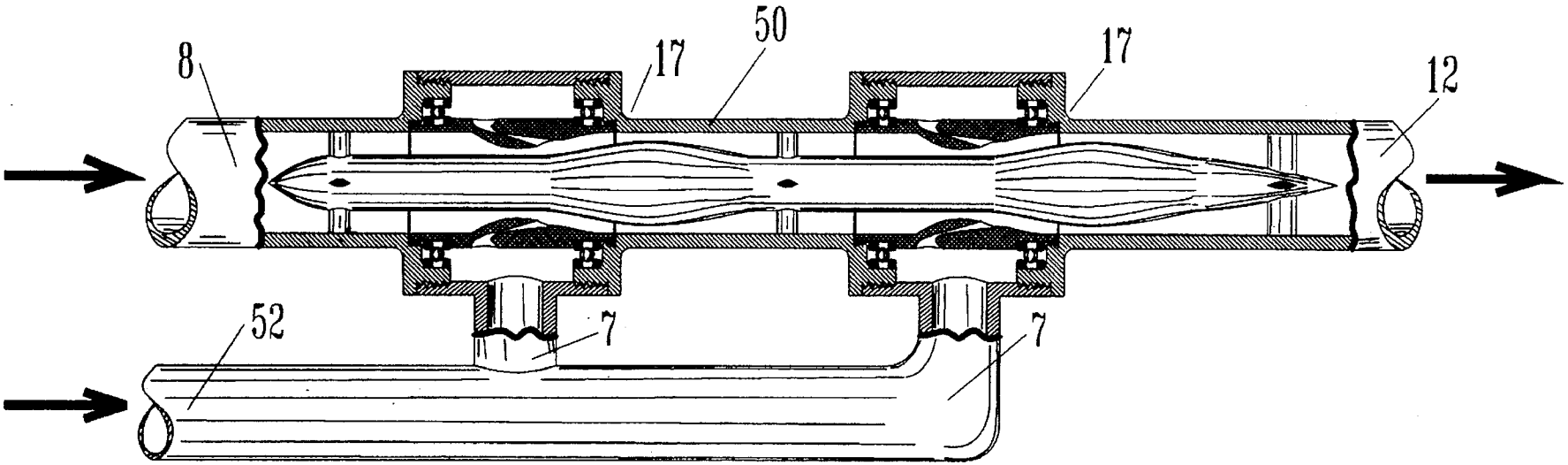
FIG. 13 shows a sectional elevation of two peripheral-nozzle pressure-exchange ejectors placed in series such that the discharge from the first ejector constitutes the secondary flow of the secondary ejector. Both ejectors have a common primary flow supply. Arrows indicate flow directions.

FIG. 13 shows an embodiment where two ejectors 17 of the type shown in FIG. 2 are placed in series. Similarly to the configuration of FIG. 11, both ejectors 17 are supplied by a common primary flow duct 52 to primary inlets 7. The secondary flow duct 8 draws the flow to the first ejector 17 which discharges through duct 50 to the secondary of the second ejector 17.

The above has been a discussion of a novel ejector concept which uses the principle of pressure exchange in order to minimize the entropy rise through the ejector. For the application of this technology to the well-known ejector refrigeration system, this will lead to levels of performance not hitherto available and will permit the use of ejector refrigeration in many applications where past attempts have proven impractical despite recognized advantages. Some general areas where this technology will be of importance is where thermal energy is readily available such as in automotive or other vehicle engines, solar power, astronautical applications where the radiant heat or cold of space can be used, or where heat from furnaces, combustors, or incinerators is available. In all of these applications, either limitations on the amount of energy used or the size and weight of condensing equipment were previously of critical importance and frequently prevented implementation. Another area where this technology will find application is in air conditioning applications where environmentally benign refrigerants are needed. Ejector refrigeration systems such as described in the present invention are highly adaptable to the use of water, the most environmentally benign refrigerant, due to the system's ability to handle large volumes of vapor.

It should also be noted that while emphasis in this disclosure is towards ejector refrigeration systems, the use of the disclosed pressure-exchange ejector will find application in many other technologies. For example, the ejector could be used to maintain cavity vacuum in chemical lasers while scavenging the products of combustion, as a supercharger for internal combustion engines, as a vacuum pump in steam power plants and many other applications requiring a highly efficient ejector. While presently preferred embodiments of the invention have been described for the purpose of this disclosure, numerous changes in the construction and arrangement of parts can be made by those skilled in the art, which changes are encompassed within the scope and spirit of this invention as defined by the appended claims.

The foregoing disclosure and the showings made in the drawings are merely illustrative of the principles of this invention and are not to be interpreted in a limiting sense.

What is claimed is:

1. An ejector compressor for transporting a compressible secondary fluid from a lower stagnation pressure supply to an ejector discharge of higher stagnation pressure, said ejector compressor utilizing pressure-exchange to affect energy transfer from an energetic primary compressible fluid to said secondary fluid, said ejector compressor comprising:

(a) an ejector housing preventing communication of the primary and secondary fluids with the environment;

(b) a primary fluid inlet duct;

(c) a plurality of supersonic nozzles of converging-diverging cross-section in the direction of flow whose inlets are in communication with said primary fluid inlet duct and which are integrated into a rotor such that the axis of discharge of one or more nozzles is located at a radial distance from the rotor's axis of rotation, said nozzles accelerate the primary fluid to supersonic speeds in such a manner as to produce compression and expansion waves in the region of the nozzle exit;

(d) said rotor being rotatably mounted in said ejector housing and provided with sealing means to minimize the communication of primary and secondary flows through flow paths other than the nozzles;

(e) rotation means so that the ratio of the peripheral speed of the nozzle to the speed of the primary fluid immediately after the compression waves is greater than 0.1.

(f) a secondary fluid inlet conduit;

(g) aerodynamic flow control surfaces interior to said housing and in the conduit of the secondary fluid placed upstream and in the vicinity of the nozzles to increase the speed of the secondary flow and to bring it into direct contact with the primary fluid in the vicinity of the nozzle exits;

(h) a pressure exchange zone in the interior of said housing and bounded by aerodynamic surfaces which may include the rotor, the housing, a center-body, or an after-body to insure the direct action of the rotating pressure wave structure on the secondary fluid;

(i) a discharge duct for the combined flow.

2. An ejector compressor according to claim 1 which includes aerodynamic surfaces interior to said housing and downstream of said pressure exchange zone for the purpose of controlling stagnation pressure loss in diffusing the high kinetic energy combined flow, said aerodynamic surfaces may be integral with the rotor, the housing, a centerbody, or an afterbody.

3. An ejector compressor according to claim 1 which includes aerodynamic surfaces downstream of said pressure exchange zone for the purpose of allowing mixing of said primary and secondary flows to achieve substantially complete energy equalization prior to diffusion, said aerodynamic surfaces may be integral with the rotor, the housing, a centerbody, or an afterbody.

4. An ejector compressor according to claim 1 whose rotation means for said rotor comprises integral nozzles whose central axes at the discharge plane are skewed tangentially relative to the axis of rotor rotation so as to generate axial angular momentum of the primary fluid when the rotor is at rest.

5. An ejector as claimed in 1 where both primary fluid and secondary fluid are of the same substance.

6. A refrigeration system operating in a closed cycle comprising:

(a) An ejector compressor according to claim 1 utilizing pressure-exchange from an energized primary driving refrigerant vapor to a secondary driven refrigerant vapor;

(b) a vapor generator;

(c) a liquid refrigerant pump;

(d) a condenser/separator;

(e) an evaporator;

(f) an expansion means;

(g) a refrigerant;

(h) a driver-fluid;

where the driver fluid is of a substantially lower molecular weight than the refrigerant fluid and where the two fluids are immiscible and both of which are liquefied in the condenser/separator. The lighter driver liquid is drawn separately from the condenser/separator and pumped into the vapor generator which discharges vapor to the primary of said ejector. The higher molecular weight refrigerant liquid is conducted to the expansion means and thence, as a colder liquid-vapor mixture, to the evaporator where said liquid refrigerant is vaporized as a result of heat extracted from the cooling space. The refrigerant vapor discharge of said evaporator is connected to the secondary flow inlet passage of said ejector-compressor. The combined driver fluid vapor and refrigerant vapor discharging from the ejector outlet is conducted to the condenser where both fluids are liquefied, and where heat rejection to an external thermal sink takes place.

7. A refrigeration system operating in a closed cycle comprising:

(a) a vapor generator;

(b) a liquid refrigerant pump;

(c) a condenser;

(d) an evaporator;

(e) an expansion means;

(f) a refrigerant;

(g) An ejector compressor according to claim 1 utilizing pressure-exchange from an energized primary driving refrigerant vapor to a secondary driven refrigerant vapor and, where the liquid refrigerant discharging from said condenser is divided into two parts, one part being drawn into the pump which discharges liquid refrigerant to said vapor generator which energizes and vaporizes said refrigerant prior to entering said ejector-compressor as the primary fluid; and, where the other part of said liquid refrigerant from the condenser discharge passes through said expansion means and into said evaporator where said liquid refrigerant is vaporized as a result of heat extracted from the cooling space. The vapor discharge of said evaporator is connected to the secondary flow inlet passage of said ejector-compressor. The vapor discharging from the ejector outlet is conducted to the condenser where it is liquefied, and where heat rejection to an external thermal sink takes place.

8. A refrigeration system according to claim 7 whereby said vapor generator includes a boiler followed by a superheater so as to produce superheated vapor.

9. A refrigeration system according to claim 7 with the improvement of including any one or more of the following heat exchangers: recuperator, a precooler, or a regenerator.

10. A refrigeration system according to claim 7 wherein said refrigeration system stages a multiplicity of ejectors in series, whereby, the vapor discharged from the first ejector is introduced as the secondary flow for the second ejector in the series, while the primary flow for the second ejector is obtained directly from the vapor generator. At each successive stage, said ejector discharges into the secondary of the following stage, and the said primary flows of all ejectors are obtained directly from the vapor generator. The last ejector in the series is discharged into the condenser.

11. A refrigeration system according to claim 7 with said refrigerant selected from the group consisting of water, chlorofluorocarbons (CFC's), hydrochlorofluorcarbons (HCFC's), ammonia, hydrocarbons, and carbon dioxide.

12. A refrigeration system according to claim 7 which is used as a space air conditioner for human comfort.

13. A refrigeration system according to claim 7 where the vapor generator is a heat exchanger placed in the path of exhaust gases in an internal combustion engine.

14. A refrigeration system according to claim 7 where the vapor generator includes a heat exchanger placed in thermal communication with the engine coolant in an internal combustion engine.

15. A refrigeration system according to claim 7 where the vapor generator includes a heat exchanger placed in thermal communication with the products of combustion of a fueled furnace.

16. A refrigeration system according to claim 7 whereby said vapor generator consists of a boiler producing substantially saturated vapor.

17. A refrigeration system according to claim 7 where the vapor generator includes a heat exchanger placed in thermal communication with a solar collector.

18. In a method of refrigeration, the steps of:

(a) extracting a liquid refrigerant from a condenser and dividing it into two conduits;

(b) from one conduit, draw liquid refrigerant by means of a pump and discharge it into a boiler;

(c) adding thermal energy from an external source to the liquid refrigerant and causing the refrigerant to boil into a vapor;

(d) discharge the vapor from the boiler to the primary of a pressure-exchanging ejector according to claim 1.;

(e) from the second conduit emanating from the condenser, direct the liquid refrigerant to an expansion means to partially vaporize the refrigerant;

(f) direct the discharge from the expansion means to an evaporator which extracts heat from the cooling space and applies it to substantially completely vaporize the refrigerant;

(g) draw the vapor from the evaporator into the secondary of said pressure-exchanging ejector;

(h) causing pressure exchange to occur inside said pressure-exchanging ejector by passing the primary vapor through a plurality of supersonic nozzles so as to produce compression and expansion waves at the nozzle discharges, and integrating said nozzles into a rotor, and providing means to produce rotation at a peripheral speed which is a substantial fraction of the primary vapor nozzle exit speed, and directing said secondary vapor into direct contact with said compression and expansion waves so as to affect pressure exchange between said primary and secondary fluids;

(i) directing the discharge of the combined primary and secondary vapor into the condenser where liquification takes place and heat is rejected to an external heat sink.

19. The method of claim 18 whereby the refrigerant is superheated after discharging from the boiler but before entering the primary of the pressure-exchange ejector.

20. The method of claim 18 whereby the pressure exchange ejector incorporates aerodynamic surfaces downstream of said pressure exchange zone for the purpose of controlling stagnation pressure loss in diffusing the high kinetic energy combined flow. Said aerodynamic surfaces may include the rotor, the housing, a centerbody, or an afterbody.

21. The method of claim 18 whereby the pressure exchange ejector incorporates aerodynamic surfaces downstream of said pressure exchange zone for the purpose of allowing mixing of said primary and secondary flows to achieve substantially complete energy equalization prior to diffusion said aerodynamic surfaces may be integral with the rotor, the housing, a centerbody, or an afterbody.

* * * * *